US009997321B2

(12) United States Patent
Lee

(10) Patent No.: US 9,997,321 B2
(45) Date of Patent: Jun. 12, 2018

(54) CIRCUIT BREAKER HAVING CLOSING RESISTOR

(71) Applicant: LSIS CO., LTD., Gyeonggi-do (KR)

(72) Inventor: Jong-Hyuk Lee, Gyeonggi-do (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days. days.

(21) Appl. No.: 15/383,025

(22) Filed: Dec. 19, 2016

(65) Prior Publication Data

US 2017/0301498 A1 Oct. 19, 2017

(30) Foreign Application Priority Data

Apr. 19, 2016 (KR) ..... 10-2016-0047375

(51) Int. Cl.

| | |
|---|---|
| ***H01H 9/00*** | (2006.01) |
| ***H01H 71/10*** | (2006.01) |
| *H01H 33/16* | (2006.01) |
| *H01H 33/70* | (2006.01) |

(52) U.S. Cl.

CPC ..... *H01H 71/10* (2013.01); *H01H 33/166* (2013.01); *H01H 33/16* (2013.01); *H01H 33/70* (2013.01)

(58) Field of Classification Search

CPC ..... H01H 71/10; H01H 33/166; H01H 33/16; H01H 33/70; H01H 9/00; H01H 9/02; H01H 9/30; H01H 9/302; H01H 9/32; H01H 9/34; H01H 9/38; H01H 9/42; H01H 9/48; H01H 9/50

USPC ..... 200/5 A, 238

See application file for complete search history.

(56) References Cited

U.S. PATENT DOCUMENTS

| | | | | |
|---|---|---|---|---|
| 3,745,284 | A | 7/1973 | Hosokawa | |
| 7,943,872 | B2 | 5/2011 | Scherl | |
| 2006/0065512 | A1* | 3/2006 | Matsui | H01H 1/60 200/285 |

FOREIGN PATENT DOCUMENTS

| | | | |
|---|---|---|---|
| EP | 2983188 | A1 | 2/2016 |
| FR | 2752086 | A1 | 2/1998 |
| JP | 5-298965 | A | 11/1993 |
| JP | H7-211199 | A | 8/1995 |
| JP | H7-272598 | A | 10/1995 |

(Continued)

OTHER PUBLICATIONS

European Search Reports dated Jun. 6, 2017 in connection with the counterpart European Patent Application No. 16203845.9.

*Primary Examiner* — Anthony R. Jimenez
(74) *Attorney, Agent, or Firm* — K&L Gates LLP

(57) ABSTRACT

Disclosed herein is a circuit breaker having a closing resistor, which is capable of preventing impact caused when the circuit breaker is opened and closed from being transferred to peripheral structures. The circuit breaker having a closing resistor includes a fixed part having a fixed contact, a movable part having a movable contact, a closing resistor unit connected to the fixed part and having a closing resistor unit contact, a closing resistor movable part connected to the movable part and having a closing resistor movable contact, and a support structure slidably coupled to the closing resistor unit in a direction parallel to a movement direction of the closing resistor movable part, thereby enabling impact and vibration applied to the closing resistor unit to be absorbed by the support structure.

2 Claims, 10 Drawing Sheets

(56) References Cited

FOREIGN PATENT DOCUMENTS

| | | | |
|---|---|---|---|
| JP | H9-17288 | A | 1/1997 |
| JP | 2015-82368 | A | 4/2015 |

* cited by examiner

CIRCUIT BREAKER HAVING CLOSING RESISTOR

CROSS REFERENCE TO RELATED APPLICATION

This application claims the benefit of Korean Patent Application No. 10-2016-0047375, filed on Apr. 19, 2016, which is hereby incorporated by reference in its entirety into this application.

BACKGROUND

1. Technical Field

The present invention relates to a circuit breaker having a closing resistor, and more particularly, to a circuit breaker including a closing resistor support structure which is capable of reducing vibration caused when the circuit breaker is opened and closed.

2. Description of the Related Art

Gas insulation switchgears (also referred to as "GISs") are switchgears which use sulfur hexafluoride ($SF_6$) gas.

Such a gas insulation switchgear may have improved safety in use as well as a compact size since a circuit breaker, which has excellent arc extinguishing performance and stable insulation characteristics, a switchgear, and a bus connection are accommodated in an airtight container filled with $SF_6$ gas. Accordingly, the gas insulation switchgears have been used in various fields.

For a circuit breaker included in an extra-high-voltage gas insulation switchgear which is used in a high-capacity system, a closing resistor unit is used to suppress an over-voltage generated when a movable part is inserted into a fixed part.

FIG. 1 is a view illustrating a conventional circuit breaker having a closing resistor.

As illustrated in the drawing, the circuit breaker having a closing resistor includes a movable part 10, a fixed part 20 which comes contact with the movable part 10 through the insertion thereof, a closing resistor movable part 30 which is connected to the movable part 10 and operates together therewith, and a closing resistor unit 40 which is connected to the fixed part 20.

The movable part 10 has a movable contact 11, and the fixed part 20 has a fixed contact 21 which comes contact with the movable contact 11. The fixed contact 21 is formed at the end of a rod which is inserted into the movable part 10.

The closing resistor movable part 30 has a closing resistor movable contact 31, and the closing resistor unit 40 has a closing resistor unit contact 41 which comes contact with the closing resistor movable contact 31.

Hereinafter, the operation of the circuit breaker having a closing resistor will be described.

FIG. 2 is a view illustrating a state in which the closing resistor unit is in contact with the closing resistor movable pail in the conventional circuit breaker having a closing resistor. FIG. 3 is a view illustrating a state in which the fixed contact is in contact with the movable contact in the conventional circuit breaker having a closing resistor.

The closing resistor movable contact 31 is operated along with the opening or closing of the movable contact 11 and the fixed contact 21 which are main contacts, and thus the closing resistor movable contact 31 and the closing resistor unit contact 41 are closed or tripped.

As illustrated in FIG. 1, when the movable part 10 is moved to the fixed part 20 in the state in which they are spaced apart from each other, the closing resistor movable contact 31 first comes into contact with the closing resistor unit contact 41. Subsequently, when the movable part 10 is further inserted into the fixed part 20, the movable contact 11 comes into contact with the fixed contact 21. In this case, the closing resistor unit contact 41 is inserted into the closing resistor unit 40 in the state in which the closing resistor unit contact 41 is in contact with the closing resistor movable contact 31. In other words, impact occurring when the closing resistor movable contact 31 is opened and closed is transferred to the closing resistor unit 40 through the closing resistor unit contact 41.

When the closing resistor movable contact 31 and the closing resistor unit contact 41 are closed, they must come into contact with each other before the movable contact 11 and the fixed contact 21, which are main contacts, come into contact with each other. When the closing resistor movable contact 31 and the closing resistor unit contact 41 are tripped, the contact therebetween must be released before the contact between the main contacts is released. For this reason, when the closing resistor movable contact 31 and the closing resistor unit contact 41 are closed or tripped, impact is applied to the closing resistor unit contact 41 from the closing resistor movable contact 31.

Since the closing resistor unit 40 having the closing resistor unit contact 41 is rigidly fixed in the conventional circuit breaker, impact due to the opening/closing of the closing resistor movable contact 31 is transferred to the closing resistor unit contact 41, and the impact transferred to the closing resistor unit contact 41 is, as it is, transferred to the closing resistor unit 40 or peripheral mechanisms connected to the closing resistor unit 40.

Due to such a structure, the closing resistor unit 40 or the mechanisms for fixing the closing resistor unit 40 may be damaged depending on the repeated opening/closing of the closing resistor movable contact. The closing resistor movable contact 31 may discontinuously come into contact with the closing resistor unit contact 41 due to vibration caused when they comes into contact with each other. When the closing resistor movable contact 31 discontinuously comes into contact with the closing resistor unit contact 41, the contacts may be damaged by burning.

As the related art, there is Korean Patent Laid-open Publication No. 10-2016-0017995 (Feb. 17, 2016) entitled "a structure for supporting a closing resistor unit for a circuit breaker"

SUMMARY

It is an aspect of the present invention to provide a circuit breaker having a closing resistor, including a support structure for supporting a closing resistor unit which is capable of absorbing impact and vibration applied to a closing resistor unit when the circuit breaker is opened and closed.

It is another aspect of the present invention to provide a circuit breaker including a support structure for supporting a closing resistor unit, which is easily assembled.

It is a further aspect of the present invention to provide a circuit breaker having a closing resistor, which can be reliably and mechanically opened and closed and have improved structural durability.

The present invention is not limited to the above aspect and other aspects of the present invention will be clearly understood by those skilled in the art from the following description.

In accordance with an aspect of the present invention, a circuit breaker includes a fixed part having a fixed contact, a movable part having a movable contact, a closing resistor unit connected to the fixed part and having a closing resistor unit contact, a closing resistor movable part connected to the movable part and having a closing resistor movable contact, and a support structure for slidably supporting the closing resistor unit in a direction parallel to a movement direction of the closing resistor movable part.

The support structure may include an insulation block coupled to a circuit breaker case, and a support guide coupled to the insulation block while the closing resistor unit is slidably coupled to the support guide.

The closing resistor unit may be coupled to the support guide by fitting a guide rod into a guide groove.

A buffer gap may be longitudinally formed between the guide groove and the guide rod.

Lubricant may be applied to the guide groove, or a bearing may be provided between the guide groove and the guide rod.

BRIEF DESCRIPTION OF DRAWINGS

FIGS. 6 to 8 are views illustrating a circuit breaker having a closing resistor according to an embodiment of the present invention, wherein FIG. 6 illustrates a state before the circuit breaker is closed, FIG. 7 illustrates a state in which a closing resistor movable contact is in contact with a closing resistor unit contact in the process of closing the circuit breaker, and FIG. 8 illustrates a state in which a movable contact is in contact with a fixed contact when the closing of the circuit breaker is completed.

DETAILED DESCRIPTION

It is noted that the terms and words used in the present specification and claims should not be construed as being limited to common or dictionary meanings but instead should be understood to have meanings and concepts in agreement with the spirit of the present invention based on the principle that an inventor can define the concept of each term suitably in order to describe his/her own invention in the best way possible. Accordingly, since the embodiments described in the present specification are nothing but one preferred embodiment of the present invention and it does not cover all the technical ideas of the invention, it should be understood that various changes and modifications may be made at the time of filing the present application.

A circuit breaker having a closing resistor according to the present invention is characterized in that a closing resistor unit is fixed by a support structure which may absorb impact due to the opening/closing of the circuit breaker in a direction parallel to the transfer direction of the impact.

Of course, among conventional closing resistor support structures, there is a closing resistor support structure in which a closing resistor unit is vertically disposed, the closing resistor support being disposed in a direction parallel to the transfer direction of impact due to the opening/closing of a circuit breaker.

Figure 1:
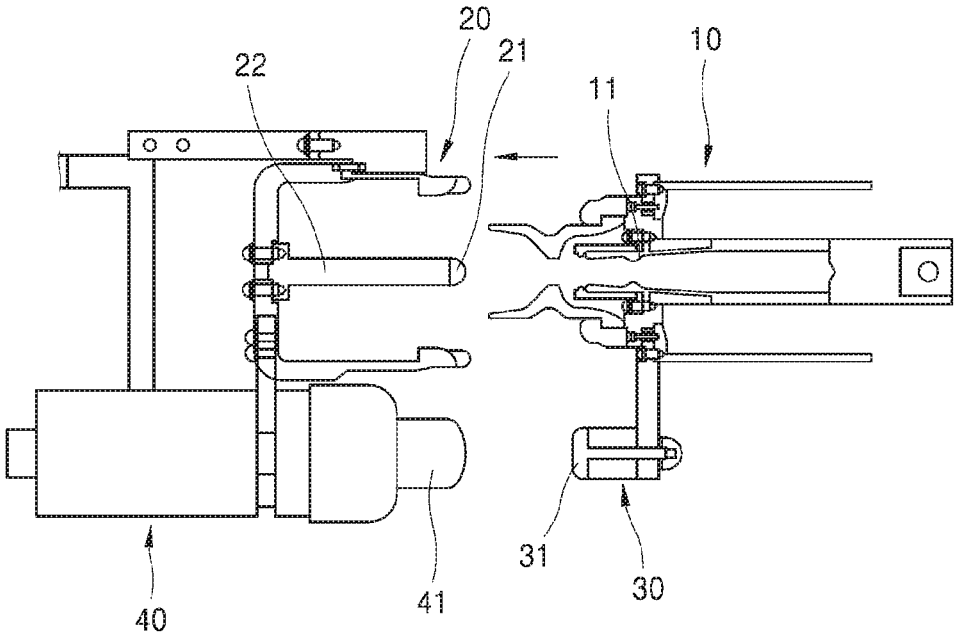
FIG. 1 is a cross-sectional view illustrating a conventional circuit breaker having a closing resistor.
Figure 2:
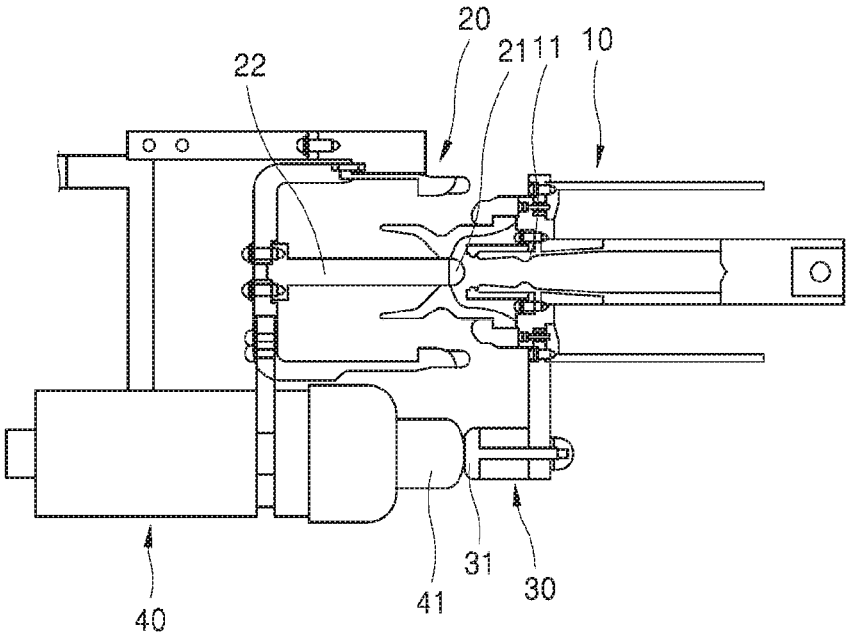
FIG. 2 is a cross-sectional view illustrating a state in which a closing resistor unit contact is in contact with a closing resistor movable contact in the conventional circuit breaker having a closing resistor.
Figure 3:
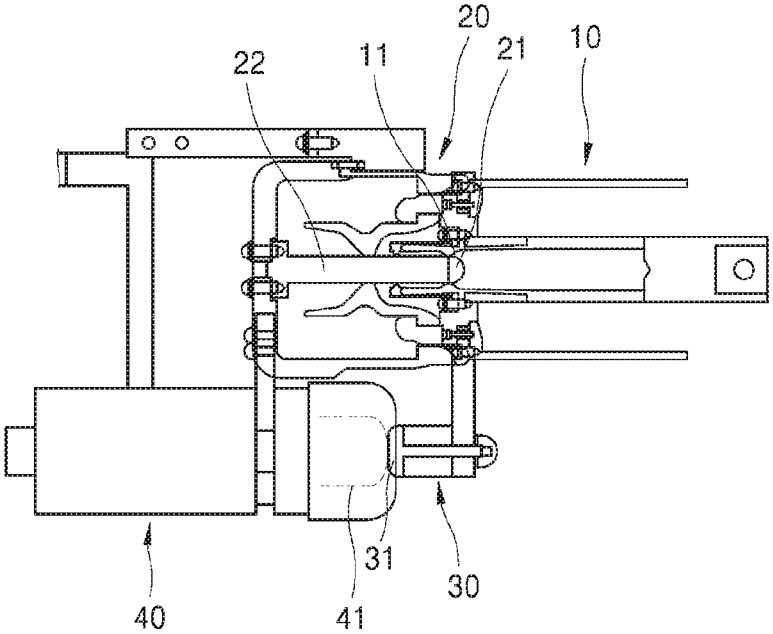
FIG. 3 is a cross-sectional view illustrating a state in which a fixed contact is in contact with a movable contact in the conventional circuit breaker having a closing resistor.
Figure 4:
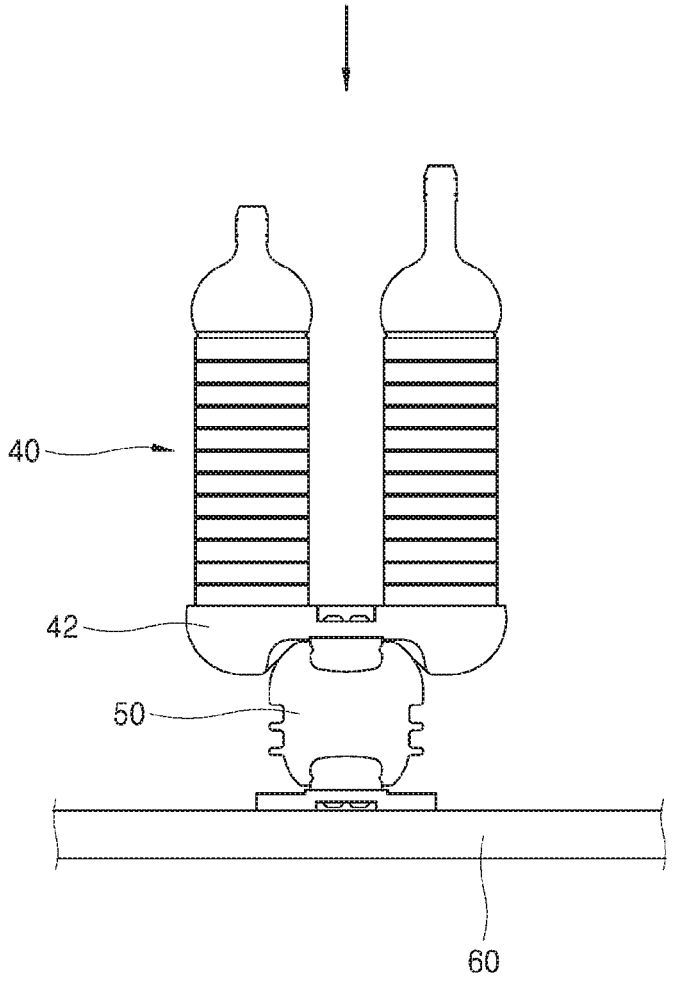
FIG. 4 is a view illustrating the vertical support structure of a closing resistor unit in a conventional circuit breaker in which the closing resistor unit is vertically disposed.

FIG. 4 is a view illustrating the vertical support structure of a closing resistor unit in a conventional circuit breaker in which the closing resistor unit is vertically disposed.

As illustrated in the drawing, when a closing resistor movable part is vertically moved, a closing resistor unit 40 is vertically disposed, and a support structure is vertically disposed in the lower portion of the closing resistor unit 40.

As illustrated in FIG. 4, the conventional vertical closing resistor support structure is a structure in which the closing resistor unit 40 is vertically disposed and a connection conductor 42 of the closing resistor unit 40 is fastened to a circuit breaker case 60 through a support insulator 50.

This structure enables insulation between the closing resistor unit 40 and the circuit breaker case 60 to be secured through the support insulator 50 and enables the support insulator 50 to vertically support the load of the closing resistor unit 40.

However, since the closing resistor unit 40, the support insulator 50, and the circuit breaker case 60 are rigidly fastened to one another, the conventional vertical closing resistor support structure does not function to absorb or reduce impact transferred to the closing resistor unit 40. Hence, the impact transferred to the closing resistor unit 40 when the circuit breaker is opened and closed may be, as it is, transferred to the circuit breaker case 60 through the support insulator 50.

Figure 5:
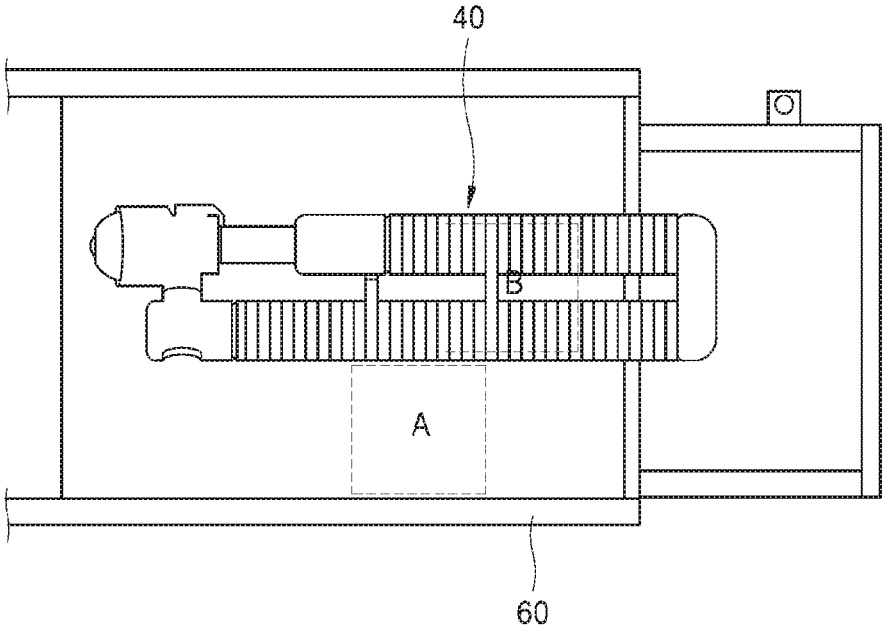
FIG. 5 is a view illustrating the support structure of a closing resistor unit in a conventional circuit breaker in which the closing resistor unit is horizontally disposed.

FIG. 5 is a view illustrating the support structure of a closing resistor unit in a conventional circuit breaker in which the closing resistor unit is horizontally disposed.

As illustrated in the drawing, when a closing resistor unit 40 is horizontally elongated and disposed, the closing resistor unit 40 is largely affected by impact due to the opening/closing of the circuit breaker during the closing and trip thereof.

When the closing resistor unit is horizontally elongated and disposed, the closing resistor unit is fixed by fastening a support structure to a circuit breaker case 60 or another component in the lower portion A or side portion B of the closing resistor unit.

The conventional support structure has a rigid form that may not absorb impact or vibration. For this reason, stress is continuously applied to the support structure and components on a current carrying path, due to vibration or impact transferred to the closing resistor unit when the circuit breaker is closed or tripped.

In addition, stress is applied between closing resistors in the closing resistor unit or to other components connected to the closing resistor unit due to vibration when the circuit breaker is repeatedly closed and tripped. Hence, the sealing of the circuit breaker case may be deteriorated and the closing resistor unit and the closing resistor movable part may be misaligned due to the continuous stress applied thereto. Moreover, secondary problems, such as contact breakage or increase in resistance in a main circuit, are caused, which may lead to a serious accident when a rated current or fault current is applied.

Figure 6:
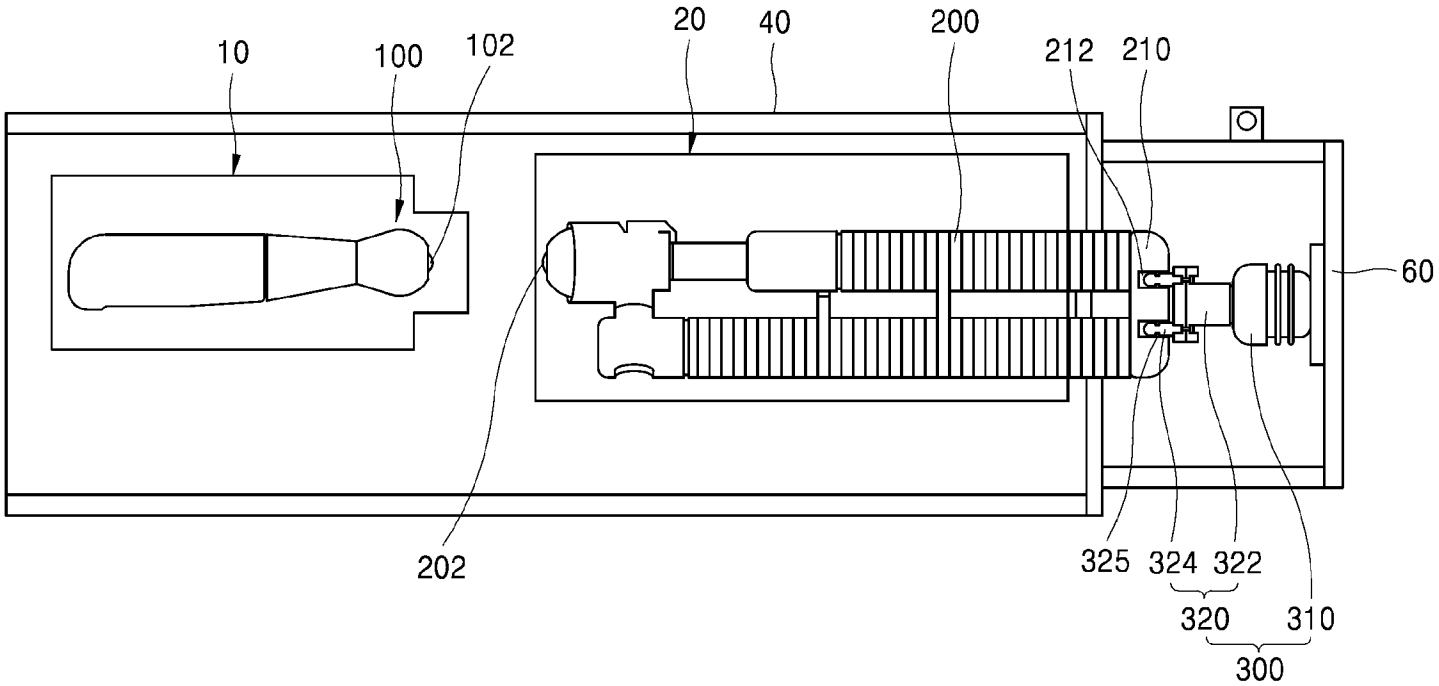
Figure 7:
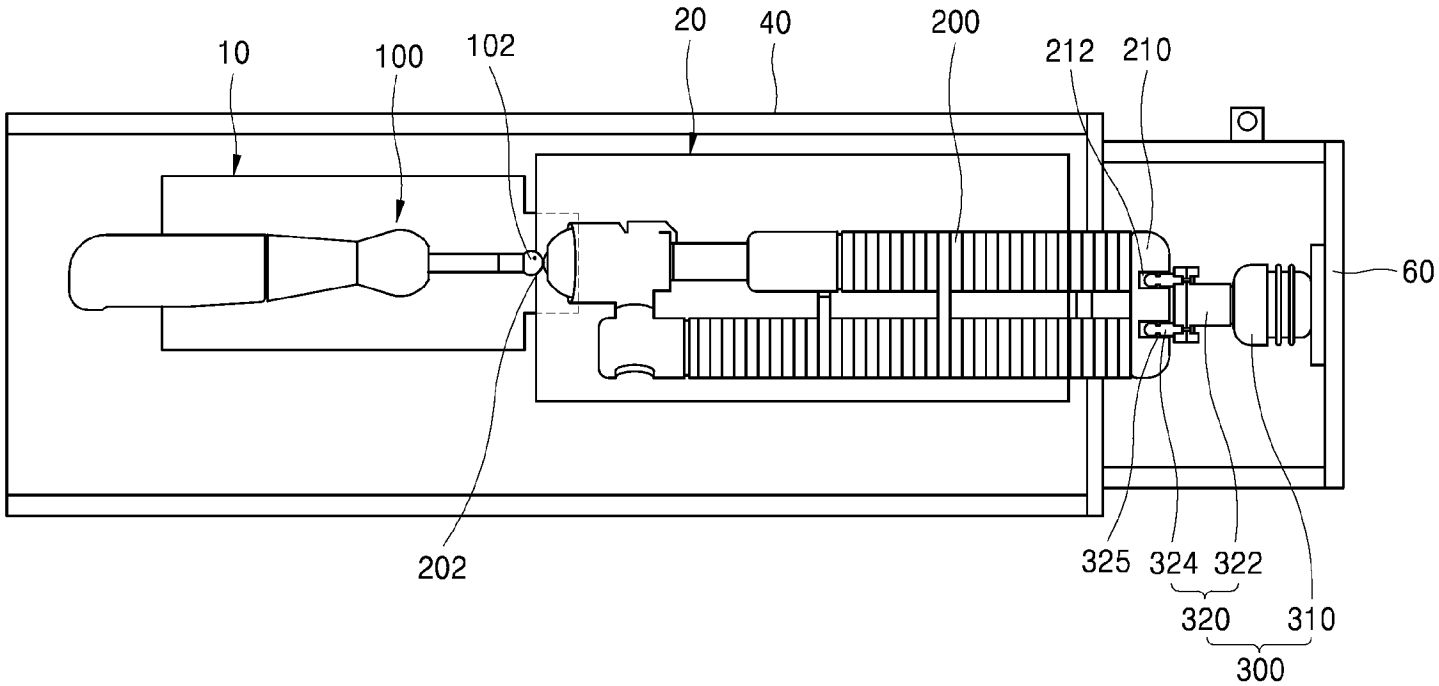
Figure 8:
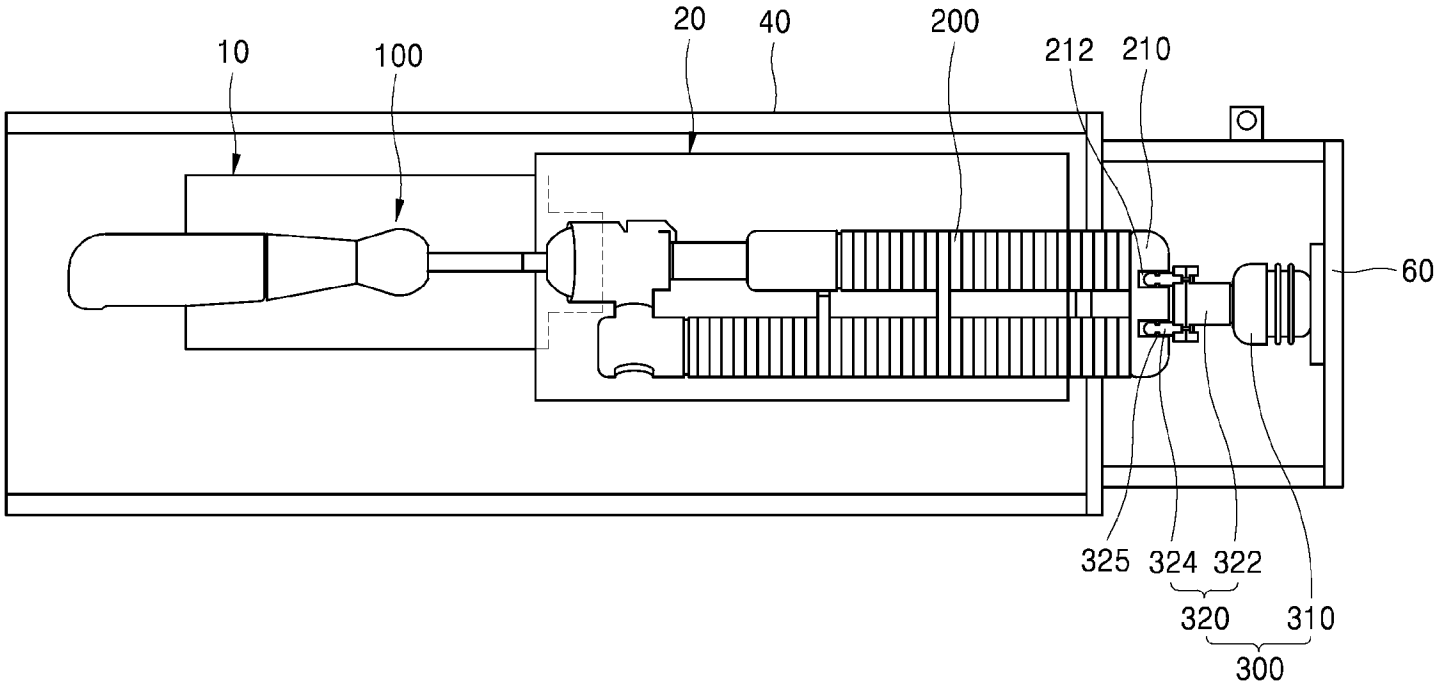

FIGS. 6 to 8 are views illustrating a circuit breaker having a closing resistor according to an embodiment of the present invention. FIG. 6 illustrates a state before the circuit breaker is closed. FIG. 7 illustrates a state in which a closing resistor movable contact is in contact with a closing resistor unit contact in the process of closing the circuit breaker. FIG. 8 illustrates a state in which a movable contact is in contact with a fixed contact when the closing of the circuit breaker is completed.

Referring to FIGS. 6 to 8, the circuit breaker having a closing resistor according to the embodiment of the present invention includes a fixed part 20 having a fixed contact, a movable part 10 having a movable contact, a closing resistor unit 200 which is connected to the fixed part 20 and has a closing resistor unit contact 202, and a closing resistor movable part 100 which is connected to the movable part 10 and has a closing resistor movable contact 102.

The present invention is characterized in that impact and vibration applied to the closing resistor unit 200 when the closing resistor movable part 100 is closed and tripped may be absorbed or relieved by a support structure for supporting a closing resistor unit 300.

The support structure for supporting a closing resistor unit 300 is disposed so as to connect a connection conductor 210 arranged at the rear end of the closing resistor unit 200 to a circuit breaker case 60.

The support structure 300 is preferably disposed in a direction parallel to the movement direction of the closing resistor movable part 100, so that impact and vibration applied to the closing resistor unit when the closing resistor movable part 100 is closed and tripped may be absorbed or relieved by the support structure 300.

The support structure 300 includes an insulation block 310 which is connected to the circuit breaker case 60, and a support guide 320 which is connected to the insulation block 301 and the connector conductor 210.

In this case, the support guide 320 is preferably connected to the connection conductor 210 in a fitting manner, so that the support guide 320 and the connection conductor 210 may move in a direction parallel to the movement direction of the closing resistor movable part through the fined structure.

The support guide 320 may be fitted into the connection conductor 210 in such a manner that the connection conductor 210 of the closing resistor unit 200 is provided with a guide grove 212 and the support guide 320 is provided with a guide rod 324 inserted into the guide groove 212.

The guide rod 324 of the support guide 320 is inserted into the guide groove 212 of the connection conductor 210 so that the support guide 320 is coupled to the connection conductor 210.

In this case, the guide rod 324 is formed such that the guide groove 212 is in parallel to the movement direction of the closing resistor movable part 100. This enables the guide rod 324 to absorb impact and vibration transferred to the closing resistor unit 200 from the closing resistor movable part 100 by sliding in the guide groove 212.

In order for the guide rod 324 to smoothly slide in the guide groove 212, lubricant may be applied to the surface of the guide groove 212 or the guide rod 324. Alternatively, a bearing 325 may be provided between the guide rod 324 and the guide groove 212, as illustrated in the drawing.

The bearing 325 has a low coefficient of friction, is made of a material having high abrasion resistance, and has a ring shape. The bearing 325 may be assembled in such a way to be fitted onto the outer peripheral surface of the guide rod 324.

The support guide 320 includes a guide body 322 and a guide rod 324.

In this case, the guide body 322 may be integrally formed with the guide rod 324. Alternatively, the guide body 322 and the guide rod 324 may be formed independently, and the guide rod 324 may be fastened to the guide body 322.

The support structure for supporting a closing resistor unit includes the support guide 320 and the insulation block 310, and the insulation block 310 serves to insulate the closing resistor unit 200 from the circuit breaker case 60.

Accordingly, the guide body 322 may be made of a conductive material. However, in order to more improve the insulation between the closing resistor unit 200 and the circuit breaker case 60, the guide body 322 may be entirely or partially made of an insulation material. For example, only the guide body 322 may be made of an insulation material, and on the guide rod 324 may be made of an insulation material.

Figure 9:
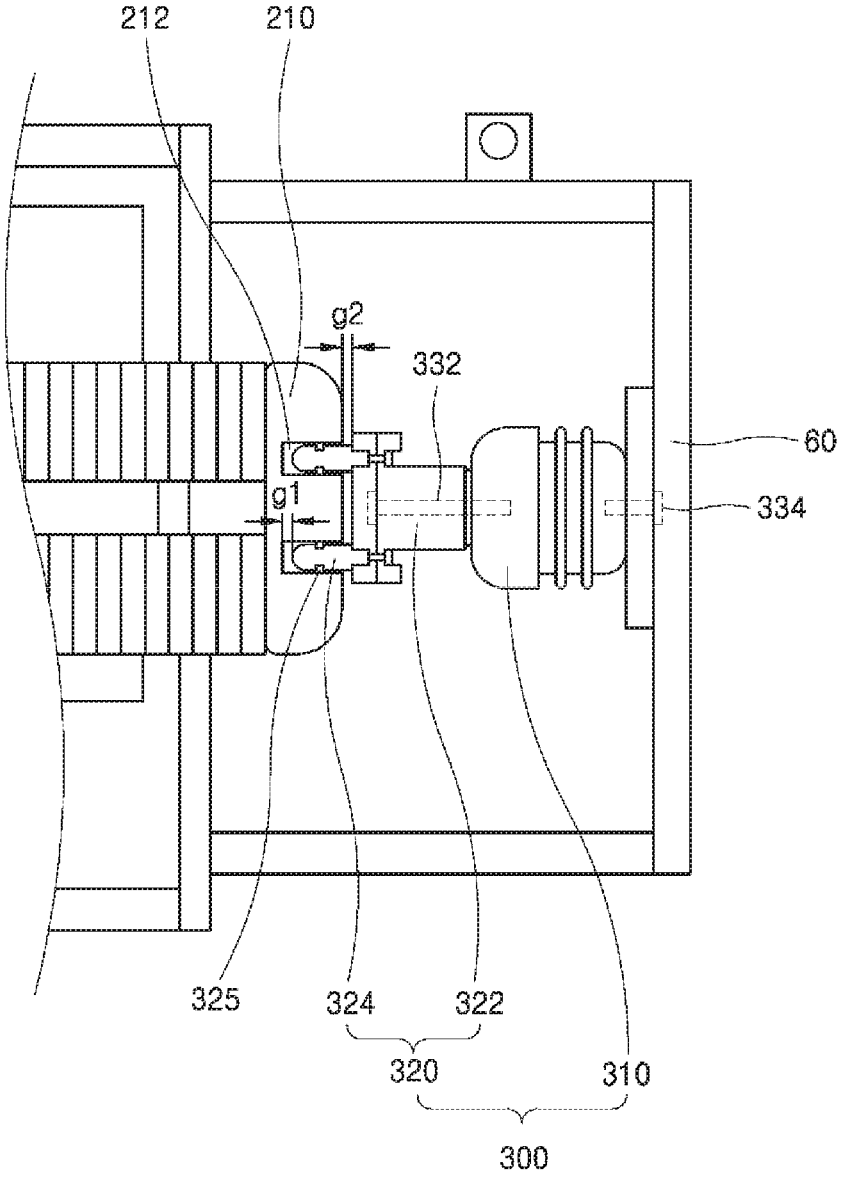
FIG. 9 is an enlarged view illustrating a support structure for supporting a closing resistor unit according to the embodiment of the present invention.

FIG. 9 is an enlarged view illustrating the support structure for supporting a closing resistor unit according to the embodiment of the present invention.

As illustrated in the drawing, in the support structure for supporting a closing resistor unit according to the embodiment of the present invention, it is preferable that the guide groove 212 is formed in the connection conductor 210 of the closing resistor unit 200, the guide rod 324 is provided in the support guide 320, the guide rod 324 is fitted into the guide groove 212, and a buffer gap g1 is longitudinally formed between the guide groove 212 and the guide rod 324.

Meanwhile, a buffer gap g2 is preferably formed in a portion in which the connection conductor 210 faces with the guide body 322 of the support guide 320. When the connection conduction 210 is in contact with the guide body 322 of the support guide 320 even though the guide rod 324 is not longitudinally in contact with the guide groove 212, the impact or vibration of the connection conductor 210 may be transferred to the support guide 320 through the contact surface therebetween.

The vibration or impact of the closing resistor unit 20 is absorbed through the buffer gaps g1 and g2, thereby preventing the vibration of the closing resistor unit 20 from being directly transferred to the support guide 320.

Meanwhile, the support guide 320 is fastened to the insulation block 310, and the insulation block 310 is fastened to the circuit breaker case 60. As a result, both sides of the insulation block 310 are fastened to the support guide 310 and the circuit breaker case 60, respectively.

When the support guide 320 is made of a conductive material, insulation must be made between the support guide 320 and the circuit breaker case 60 by the insulation block 310.

To this end, it is preferable that a first fastening means 332 for fastening the support guide 320 to the insulation block 310 and a second fastening means 334 for fastening the insulation block 310 to the circuit breaker case 60 are provided independently, and the first and second fastening means 332 and 334 are disposed so as not to come into contact with each other. If the first and second fastening means 332 and 334 are formed independently, the support guide 320, the insulation block 310, and the circuit breaker case 60 must be fastened to one another using a single fastening means.

This is not preferable because a current flows from the closing resistor unit 200 to the circuit breaker case 60 through the fastening means. When the first and second fastening means 332 and 334 come into contact with each other even though they are formed independently, a current flows from the closing resistor unit 200 to the circuit breaker case 60 through the first and second fastening means 332 and 334. Hence, this is not preferable.

Figure 10:
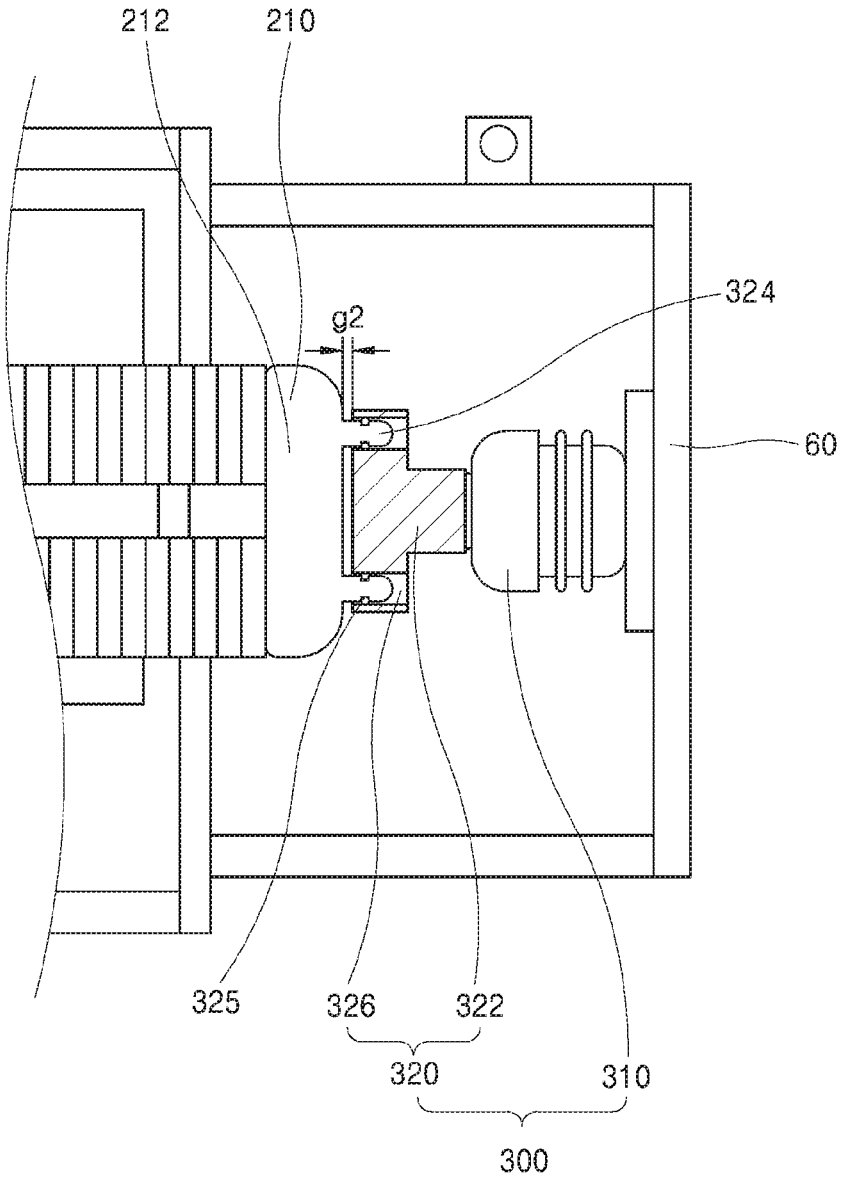
FIG. 10 is an enlarge view a support structure for supporting a closing resistor unit according to another embodiment of the present invention.

FIG. 10 is an enlarge view a support structure for supporting closing resistor unit according to another embodiment of the present invention.

In the present embodiment, a guide rod 324 is provided in a connection conductor 210 of a closing resistor unit 200, a guide groove 326 is formed in a support guide 320, and the guide rod 324 of the connection conductor 210 is fitted into the guide groove 326 of the support guide 320. The guide groove 326 formed In the support guide 320 is a through-hole in the present embodiment, but the guide groove 326 may be a hole, one end of which is clogged, similarly to the above embodiment. When the guide groove 326 is a hole, one end of which is clogged, an operation gap must be longitudinally formed between the guide groove 326 and the guide rod 324.

When the guide groove 326 is a through-hole, no contact longitudinally occurs between the guide groove 326 and the guide rod 324. Therefore, the same effect as forming the operation gap may be exhibited.

Since such a structure allows the same operation and effect to be exhibited except that the guide groove 326 and the guide rod 324 are formed in the members opposite to those of the above embodiment, a repeated description thereof will be omitted.

In accordance with a circuit breaker having a closing resistor of the present invention, it is possible to reduce mechanical stress applied to the other components of the circuit breaker by preventing impact, which is transferred to a closing resistor unit when the circuit breaker is opened and closed, from being transferred to other structures. Thus, it is possible to reduce waste due to the over-spec of mechanical strength in the process of designing the product, and to stabilize the mechanical structure of the circuit breaker having a closing resistor.

In addition, a support structure for supporting a closing resistor unit is assembled in the latter half of the assembly of the circuit breaker having a closing resistor, and the support structure is assembled in such a manner that it is inserted into the closing resistor unit. Therefore, it is possible to improve assembly and convenience of maintenance.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A circuit breaker, which includes a fixed part having a fixed contact, a movable part having a movable contact, a closing resistor unit connected to the fixed part and having a closing resistor unit contact, and a closing resistor movable part connected to the movable part and having a closing resistor movable contact, the circuit breaker comprising:

a support structure having an insulation block coupled to a circuit breaker case and a support guide coupled to the insulation block, wherein the closing resistor unit is coupled to the support guide by fitting a guide rod in the support guide into a guide groove in the closing resistor unit, wherein a buffer gap is longitudinally formed between the guide groove and the guide rod, wherein the closing resistor unit is slidably supported in a direction parallel to a movement direction of the closing resistor movable part.

2. The circuit breaker according to claim 1, wherein lubricant is applied between the guide groove and the guide rod, or a bearing is provided between the guide groove and the guide rod.

* * * * *